US007234529B2

(12) United States Patent
Surjaatmadja

(10) Patent No.: US 7,234,529 B2
(45) Date of Patent: Jun. 26, 2007

(54) FLOW SWITCHABLE CHECK VALVE AND METHOD

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 321 days.

(21) Appl. No.: 10/819,593

(22) Filed: Apr. 7, 2004

(65) Prior Publication Data

US 2005/0224231 A1 Oct. 13, 2005

(51) Int. Cl.
*E21B 34/14* (2006.01)

(52) U.S. Cl. ..... 166/374; 166/323; 166/325

(58) Field of Classification Search ..... 166/373, 166/374, 321, 323, 325, 328, 381; 137/515, 137/517, 535, 538, 543.21, 522, 542; 251/230, 251/257

See application file for complete search history.

(56) References Cited

U.S. PATENT DOCUMENTS 3,139,142 A * 6/1964 Chisholm et al. ..... 166/325
3,957,114 A 5/1976 Streich
4,067,358 A * 1/1978 Streich ..... 137/515
4,515,218 A * 5/1985 Bissonnette ..... 166/328
4,624,316 A 11/1986 Baldridge et al.
4,846,281 A 7/1989 Clary et al.
4,917,349 A 4/1990 Surjaatmadja et al.
5,529,126 A 6/1996 Edwards
5,533,571 A 7/1996 Surjaatmadja et al.
5,765,642 A 6/1998 Surjaatmadja
5,894,890 A 4/1999 Garcia-Soule et al.
5,921,318 A * 7/1999 Ross ..... 166/381
6,047,949 A * 4/2000 Beauchemin, Jr. ..... 251/257

(Continued)

FOREIGN PATENT DOCUMENTS

EP 0 255 269 A2 2/1988

(Continued)

OTHER PUBLICATIONS

Schlumberger, "J-slot", from website: www.glossary.oilfield.slb.com/Display.cfm?Term=Jslot, Mar. 31, 2004.

(Continued)

*Primary Examiner*—Lanna Mai
*Assistant Examiner*—Matthew J. Smith
(74) *Attorney, Agent, or Firm*—John W. Wustenberg; Baker Botts L.L.P.

(57) ABSTRACT

According to one embodiment of the invention, a flow switchable check valve includes a housing, a guide member having a bore extending therethrough disposed within the housing, and a poppet having a head and a stem. The head has an upstream surface engaged with a seating surface on the housing when the poppet is in a first position. A pin extends into a groove such that the pin follows a pattern of the groove when the poppet is translated within the housing. The pattern is configured to direct the poppet from the first position to a second position when a force is applied to the head, and further configured to direct the poppet from the second position to a third position when the force is removed from the head, in which the third position is downstream from the first position.

12 Claims, 4 Drawing Sheets

U.S. PATENT DOCUMENTS 6,173,795 B1 * 1/2001 McGarian et al. ..... 166/321
2004/0026085 A1 2/2004 Vacik et al.

FOREIGN PATENT DOCUMENTS

EP 1 380 720 A1 1/2005
GB 2 391 239 A 7/2003

OTHER PUBLICATIONS

Schlumberger, "J-slot", from website: www.glossary.oilfield.slb.com/DisplayImage.cfm?ID=477, Mar. 31, 2004.
Foreign communication from related counter part application dated Apr. 4, 2005.

* cited by examiner

FLOW SWITCHABLE CHECK VALVE AND METHOD

BACKGROUND

The present invention relates generally to fluid control valves and, more particularly, to a flow switchable check valve for downhole tools.

Various procedures have been developed and utilized to increase the flow of hydrocarbons from hydrocarbon-containing subterranean formations penetrated by wellbores. For example, a commonly used production stimulation technique involves creating and extending fractures in the subterranean formation to provide flow channels therein through which hydrocarbons flow from the formation to the wellbore. The fractures are created by introducing a fracturing fluid into the formation at a flow rate which exerts a sufficient pressure on the formation to create and extend fractures therein. Solid fracture proppant materials, such as sand, are commonly suspended in the fracturing fluid so that upon introducing the fracturing fluid into the formation and creating and extending fractures therein, the proppant material is carried into the fractures and deposited therein, whereby the fractures are prevented from closing due to subterranean forces when the introduction of the fracturing fluid has ceased.

In such formation fracturing and other production stimulation procedures, hydraulic fracturing tools and other production enhancement and completion tools often use fluid circulation to operate the downhole tools to obtain the desired result. The control of fluid circulation paths are achieved in many instances by check valves, such as ball valves that open when fluid flows in one direction and close when fluid flows in the opposite direction.

SUMMARY

According to one embodiment of the invention, a flow switchable check valve includes a housing, a guide member having a bore extending therethrough disposed within the housing, and a poppet having a head and a stem. The head has an upstream surface engaged with a seating surface on the housing when the poppet is in a first position. A pin extends into a groove such that the pin follows a pattern of the groove when the poppet is translated within the housing. The pattern is configured to direct the poppet from the first position to a second position when a force is applied to the head, and further configured to direct the poppet from the second position to a third position when the force is removed from the head, in which the third position is downstream from the first position.

Some embodiments of the invention provide numerous technical advantages. Some embodiments may benefit from some, none, or all of these advantages. For example, according to certain embodiments, a flow switchable check valve allows fluid circulation flexibility downhole. The check valve is designed such that it is able to close or allow reverse circulation when desired. Depending on the pattern of J-slot associated with the valve and the number of valves, a myriad of circulation arrangements are available to wellbore producers without having to use expensive valving arrangements or make multiple trips into the wellbore.

For example, during certain hydraulic fracturing operations that use one or more fracturing tools, such a valve may be used for the bottom check valve below the fracturing tool to pressurize the tool or above the tool to stop flow back. Used as the bottom valve, such a valve allows pressuring, reverse circulating, and after switching, perform high flow, low pressure circulating into the annulus. Used as the top valve, this valve allows pumping down, then quickly stop flow back (for disconnecting and moving pipe), and after switching, allow reverse circulating.

DETAILED DESCRIPTION

Figure 1A:
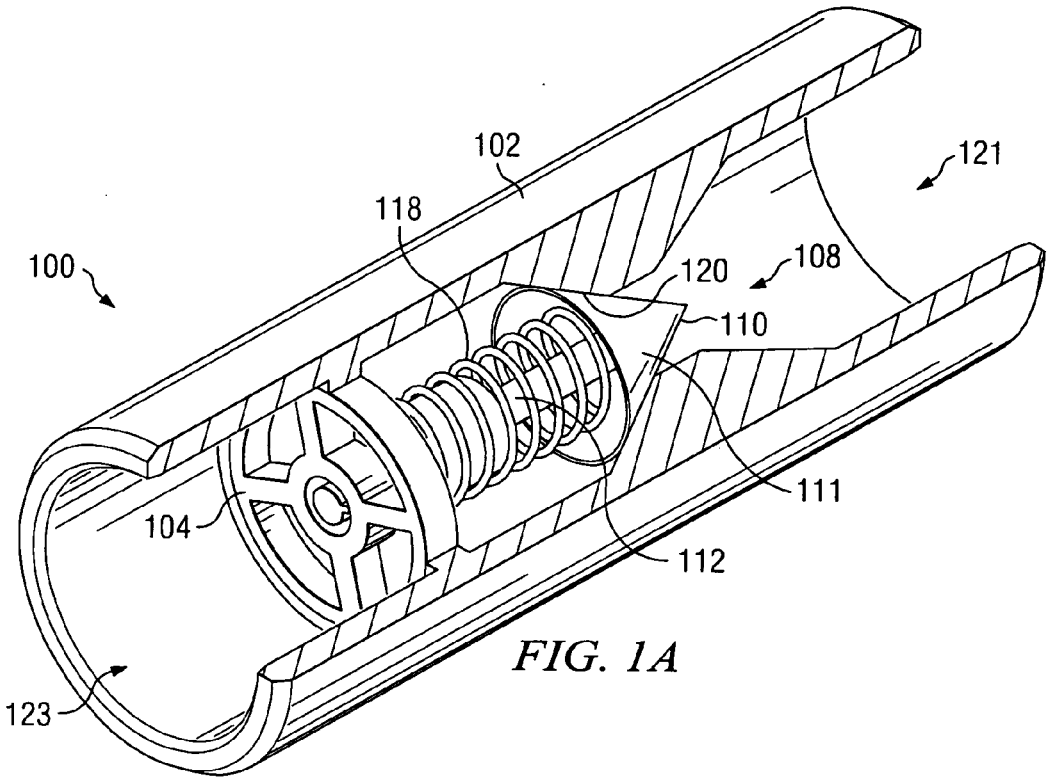
FIGS. 1A and 1B are perspective and end views, respectively, of a flow switchable check valve in accordance with one embodiment of the present invention.
Figure 1B:
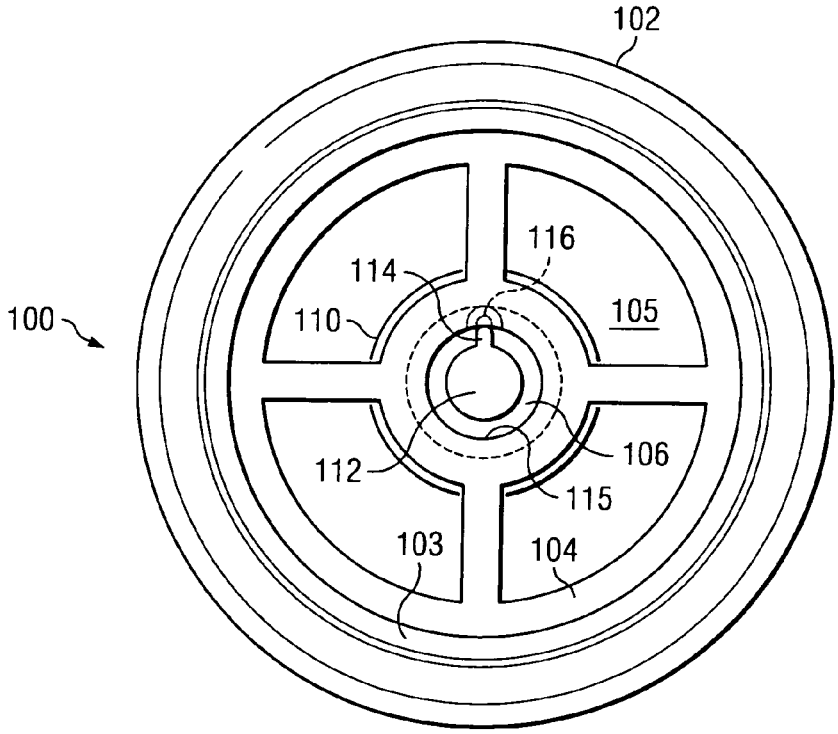

FIGS. 1A and 1B are perspective and end views, respectively, of a flow switchable check valve 100 in accordance with one embodiment of the present invention. As described in greater detail below, in addition to acting as a check valve, flow switchable check valve 100 may be selectively held in an open position to facilitate reverse circulation of fluid when desired. Although check valve 100 may be utilized in any suitable piping system in which fluid flows, check valve 100 is particularly suitable for use in downhole assemblies because a myriad of circulation arrangements are available in surface equipment; yet there are not many choices for downhole assemblies without having to use expensive valving arrangements or make multiple trips into a wellbore.

In the illustrated embodiment, check valve 100 includes a housing 102, a guide member 104 disposed within housing 102 and having a bore 106 extending therethrough, a poppet 108 having a head 110 and a stem 112, and a pin or lug 114 extending into a groove 116 formed in bore 106. For the purposes of this detailed description, the "upstream" end of check valve 100 is designated by reference number 121 and the "downstream" end of check valve 100 is designated as reference numeral 123. However, fluid may flow in either direction within check valve 100.

Housing 102 is any suitably shaped housing having any suitable length and formed from any suitable material. In one embodiment, housing 102 is a cylindrically shaped housing having a diameter suitable for attaching to portions of pipe at both upstream end 121 and downstream end 123 so that a suitable fluid may flow therethrough. Housing 102 includes a seating surface 120 that engages an upstream surface 111 of head 110 when check valve 100 is in a "closed position." To aid in the engagement of upstream surface 111 with seating surface 120, a biasing member 118 may be utilized, such as a spring or other suitable elastic member that is operable to oppose downstream translation of poppet 108 with respect to guide member 104. However, depending upon the positioning and use of check valve 100, biasing member 118 may not be needed. Although illustrated as being disposed on the upstream side of guide member 104, biasing member 118 may be disposed on downstream side of guide member 104. Housing 102 may also include a ledge 103 for coupling guide member 104 thereto. However, guide member 104 may be coupled to housing 102 in any suitable manner.

Guide member 104 may be coupled to housing 102 in any suitable manner and functions to guide poppet 108 when poppet 108 translates within housing 102. Guide member 104 may have any suitable configuration that allows fluid to flow through housing 102. For example, guide member 104 may have any number of suitable openings 105 formed therein to allow fluid flow. In the illustrated embodiment, guide member 104 includes groove 116 formed in the wall 115 of bore 106 to facilitate the guidance of poppet 108 when poppet 108 translates either downstream or upstream. Details of groove 116 according to various embodiments of the invention are described in more detail below in conjunction with FIGS. 2A and 2B.

Poppet 108 may be any suitable poppet, dart, piston or other suitable element that translates within housing 102 in order to regulate fluid flow through check valve 100. The state of poppet 108 determines the type of fluid flow (or absence of fluid flow) through housing 102. Poppet 108 includes head 110 that may have any suitable shape and that functions to either allow or disallow flow through housing 102. In the illustrated embodiment, head 110 is cone shaped; however, head 110 may have any suitable shape. Stem 112, is slidably disposed within bore 106 of guide member 104 and may have any suitable length and any suitable diameter. In order to facilitate the guidance of poppet 108 within guide member 104, stem 112 includes a pin 114 that extends into groove 116. Both pin 114 and groove 116 may have any suitable cross-sectional contour that facilitates the guidance of pin 114 by groove 116. Although in the illustrated embodiment pin 114 is coupled to stem 112 and groove 116 is formed in the wall of bore 106, pin 114 may extend outwardly from the wall of bore 106 while groove 116 is formed in stem 112 in other embodiments.

Figure 2A:
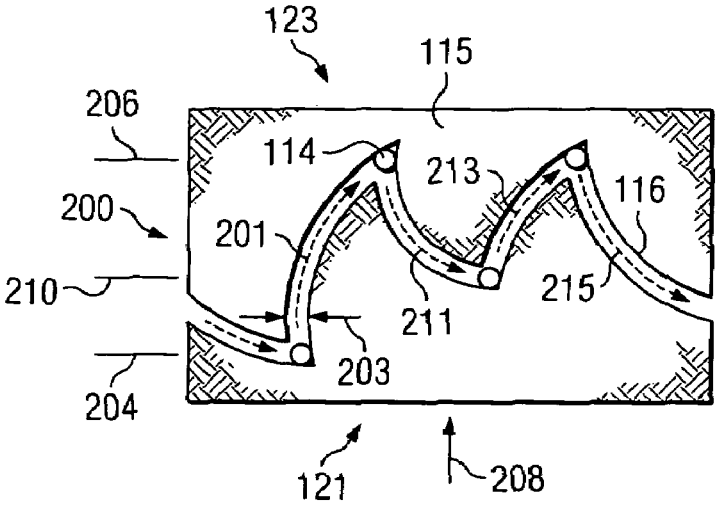
FIGS. 2A and 2B illustrate two different groove patterns in accordance with various embodiments of the present invention.
Figure 2B:
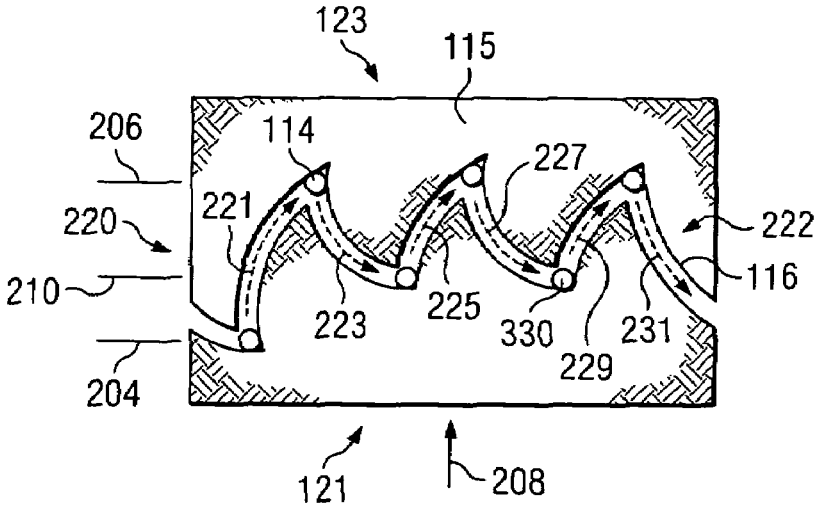

FIGS. 2A and 2B illustrate two different groove patterns for groove 116 in accordance with various embodiments of the present invention. Both FIGS. 2A and 2B illustrate wall 115 of bore 106 in a flattened out view for purposes of clarity of description.

Referring to FIG. 2A, a pattern 200 of groove 116 is illustrated. Pattern 200 includes a pair of J-slots coupled to one another to form a continuous groove 116. Although groove 116 is illustrated in FIG. 2A as having a width 203 approximately twice as large as the diameter of pin 114, groove 116 may have any suitable width 203 and pin 114 may have any suitable diameter.

Pattern 200 is configured in FIG. 2A to direct pin 114 from a first position 204 to a second position 206 when a force is applied to head 110 from upstream side 121 of check valve 100. The force direction is indicated by arrow 208 in FIG. 2A. First position 204 represents the closed position for poppet 108 when upstream surface 111 is engaged with seating surface 120 (see FIG. 1), which prevents flow in either direction through housing 102. As the force is applied to head 110 and poppet 108 is translated, pin 114 translates from first position 204 to second position 206, as indicated by arrow 201. This causes poppet 108 to rotate slightly as pin translates along the path of arrow 201. Although any suitable force may be applied, in one embodiment, the force is applied by a fluid flowing through check valve 100 from the upstream direction.

At second position 206, check valve 100 is in an open position so that fluid may flow therethrough. When the force as indicated by arrow 208 is removed from head 110, pin 114 translates from second position 206 to a third position 210, as indicated by arrow 211, because of the force exerted by biasing member 118 or other suitable force. This also causes poppet 108 to rotate slightly as pin translates along the path of arrow 211. Third position 210 indicates a slightly or otherwise open condition for check valve 100 where fluid is still allowed to flow through check valve 100 in either direction. This state may allow reverse circulation through check valve 100.

When a subsequent force is applied to head 110 from upstream end 121, poppet 108 is translated within housing 102 and pin 114 translates from third position 210 back to second position 206, as indicated by arrow 213. Check valve 100 is then again in a fully open condition so that fluid may flow freely-therethrough. After the subsequent force is removed, pin 114 then travels through groove 116 back to first position 204, as indicated by arrow 215. Check valve 100 is now in a fully closed position in which upstream surface 111 engages seating surface 120 on housing 102. In other words, poppet 108 has made one full revolution and is back to its original position.

Thus, depending on the number of fluid circulation paths run through check valve 100, check valve 100 may either end up being in a closed position or an open position depending upon where pin 114 is within groove 116, which defines the state of poppet 108. First position 204 indicates a closed position for check valve 100, second position 206 indicates an open position for check valve 100 when fluid is flowing through check valve 100 from upstream side 121, and third position 210 indicates a slightly open position for check valve 100, in which a reverse circulation of fluid from downstream side 123 towards upstream side 121 is allowed. This flexibility in circulation for check valve 100 is particularly advantageous for downhole procedures such as hydraulic fracturing and other operations.

Referring to FIG. 2B, a pattern 220 of groove 116 is illustrated. Pattern 220 is similar to pattern 200 of FIG. 2A, except that pattern 220 comprises three successive J-slots coupled to one another to form a continuous groove 116. An additional J-slot 222 in pattern 220 allows poppet 108 to be in an open position that allows reverse circulation after two cycles of fluid flow through check valve 100, as opposed to pattern 200 which closes check valve 100 after two cycles of fluid flow through check valve 100. This is illustrated by the path that pin 114 takes during each cycle of fluid flow.

More specifically, pin 114 is in first position 204 before the force as indicated by arrow 208 is applied to head 110 and translates along groove 116, as indicated by arrow 221, to second position 206 when the force is applied the first time. After the force is removed, pin 114 then translates along groove 116 to third position 210, as indicated by arrow 223. A subsequent force as indicated by arrow 208 applied to head 110 translates pin 114 from third position 210 back to second position 206, as indicated by arrow 225. When this subsequent force is removed, then pin 114 translates along groove 116 back to third position 210 instead of first position 204 as it does in pattern 200 of FIG. 2A. Pin 114 then translates along groove 116 back to second position 206 when another force as indicated by arrow 208 is applied to head 110, and after this force is removed, then pin 114 translates back to first position 204, as indicated by arrow 231. Poppet 108 is now back to its original closed position and has made one full revolution.

Thus, pattern 220 allows poppet 108 to be open after a first cycle of fluid, open after a second cycle of fluid, and then closed after a third cycle of fluid. This allows a greater number of fluid circulation possibilities for check valve 100, especially when used in combination with a check valve 100 that has pattern 200 as described above. This is illustrated in greater detail below in conjunction with FIG. 3, in which an example use of two different check valves 100 having two different groove patterns are utilized.

Figure 3:
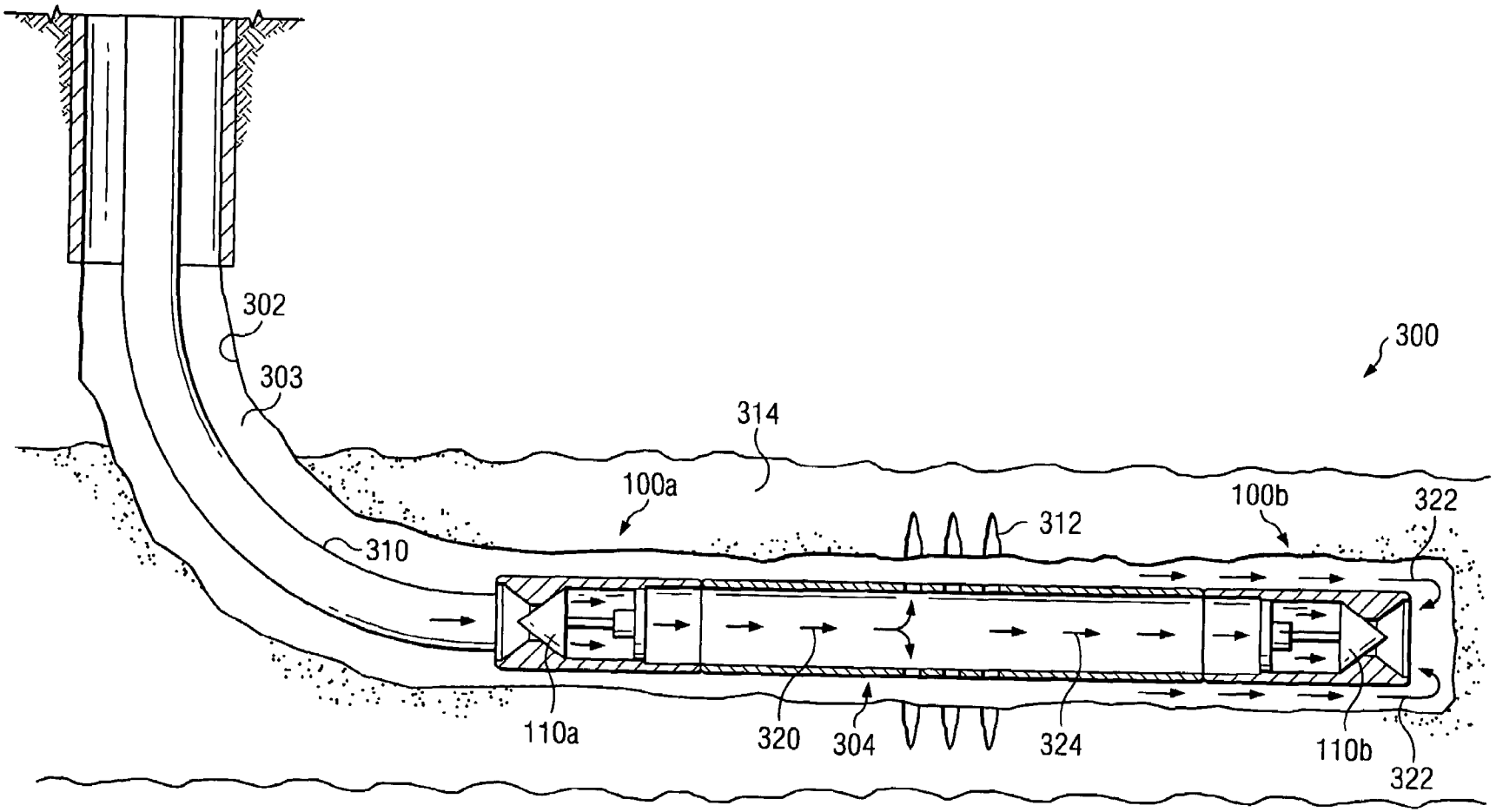
FIG. 3 is an elevation view of a downhole tool including a hydraulic fracturing sub utilizing a pair of flow switchable check valves in accordance with an embodiment of the present invention.

FIG. 3 is an elevation view of a system 300 for regulating fluid flow in a wellbore 302 in accordance with one embodiment of the present invention. System 300 illustrates a technical advantage of check valve 100 as described above in conjunction with FIGS. 1A through 2B. In the illustrated embodiment, system 300 includes a downhole tool 304 disposed between a first check valve 100*a* and a second check valve 100*b*, and tubing 310 coupled to first check valve 100*a*. Tubing 310, first and second check valves 100*a*, 100*b* and downhole tool 304 are illustrated as being disposed within wellbore 302, which may be any suitable wellbore drilled using any suitable drilling technique.

In the example embodiment, first check valve 100*a* includes a groove 116 having a pattern 220 illustrated in FIG. 2B and second check valve 100*b* includes a groove 116 having a pattern 200 as indicated in FIG. 2A. In addition, first check valve 100*a*, which is upstream from second check valve 100*b*, is positioned such that a head 110*a* faces upstream, while a head 110*b* of second check valve 100*b* faces downstream.

Downhole tool 304, in the illustrated embodiment, is a hydraulic fracturing sub that is utilized to produce a plurality of fractures 312 in a subterranean zone 314, such as during Halliburton's SURGIFRAC fracturing process. Details of this process may be observed in U.S. Pat. No. 5,765,642. The present invention, however, contemplates downhole tool 304 being other types of downhole tools performing other types of operations within wellbore 302. Downhole tool 304 may couple to check valves 100*a*, 100*b* in any suitable manner, such as welding or a screwed connection. Tubing 310 may also couple to first check valve 100*a* in any suitable manner and may be any suitable elongated body, such as sectioned pipe or coiled tubing that is operable to transport fluid therein.

Both first check valve 100*a* and second check valve 100*b* function in a similar manner to check valve 100, as described above. The difference between first check valve 100*a* and second check valve 100*b* is that first check valve 100*a* includes pattern 220 while second check valve 100*b* includes pattern 200. This combination allows a myriad of fluid circulation possibilities for system 300. For example, a first circulation of fluid down through tubing 310, as indicated by reference numeral 320, causes first check valve 100*a* to open and remain open when the first circulation of fluid is stopped. This circulation of fluid may be used during the hydraulic fracturing process in which second check valve 100*b* must be closed in order to create sufficient pressure for the fluid to fracture subterranean zone 314. When this fluid circulation 320 is stopped, then first check valve 100*a* remains open, as described above in conjunction with FIG. 2B. Referring to FIG. 2B, this open condition corresponds to the positioning of pin 114 in third position 210.

Referring back to FIG. 3, since first check valve 100*a* is now in third position 210, reverse circulation through first check valve 100*a* is allowed. This allows a second circulation of fluid, as indicated by reference numeral 322, to circulate down an annulus 303 of wellbore 102 and up through second check valve 100*b*, downhole tool 304, first check valve 100*a* (since first check valve 100*a* is still open), and tubing 310. This also opens second check valve 100*b*, since fluid circulation 322 corresponds to the positioning of pin 114 at second position 206 (FIG. 2A). When the second circulation of fluid 322 is stopped, second check valve 100*b* remains open because pin 114 moves along the path as indicated by arrow 223 to third position 210.

At this point no fluid is flowing in wellbore 302 and first check valve 100*a* and second check valve 100*b* are both in an open position. This means that a third circulation of fluid, as indicated by reference numeral 324, may be run downhole through tubing 310 and continue through first check valve 100*a*, downhole tool 304, second check valve 100*b*, and back up through annulus 303. This facilitates high-flow, low-pressure circulation into annulus 303.

Thus, flexibility in circulation of fluid downhole saves considerable time and money because the operator of downhole tool 304 does not have to remove downhole tool 304 from wellbore 302 to change the type of check valves used in order to obtain certain circulation flows. They merely have to flow fluid down either annulus 303 or tubing 310 in order to obtain the desired fluid circulation.

Downhole tool 304 may then be moved into a different portion of wellbore 302 in order to perform an additional hydraulic fracturing operation or other suitable operation depending upon the type of downhole tool 304. At this new position within wellbore 302, first circulation of fluid 320 may be utilized in the hydraulic fracturing of this other location within subterranean zone 314. After the first circulation 320 is then removed, first check valve 100*a* is still in the open position since it has pattern 220, as indicated in FIG. 2B. The positioning of pin 114 is now in position as indicated by reference numeral 330 that corresponds to third position 210, which means that first check valve 100*a* is still in the open position. Second circulation of fluid 322 may then be performed, as indicated above. However, this second circulation of fluid 322 after it has stopped, closes second check valve 100*b* because it has pattern 220, as indicated in FIG. 2A. In other words, pin 114 is back in first position 204. Third circulation of fluid 324 then may not be performed because second check valve 100*b* is closed. In order to open second check valve 100*b* back open a subsequent circulation of fluid, similar to second circulation 322, is required in order to move pin 114 to second position 206, as indicated in FIG. 2A. Third circulation of fluid 324 may then be performed since both first check valve 100*a* and second check valve 100*b* are in an open position.

Figure 4:
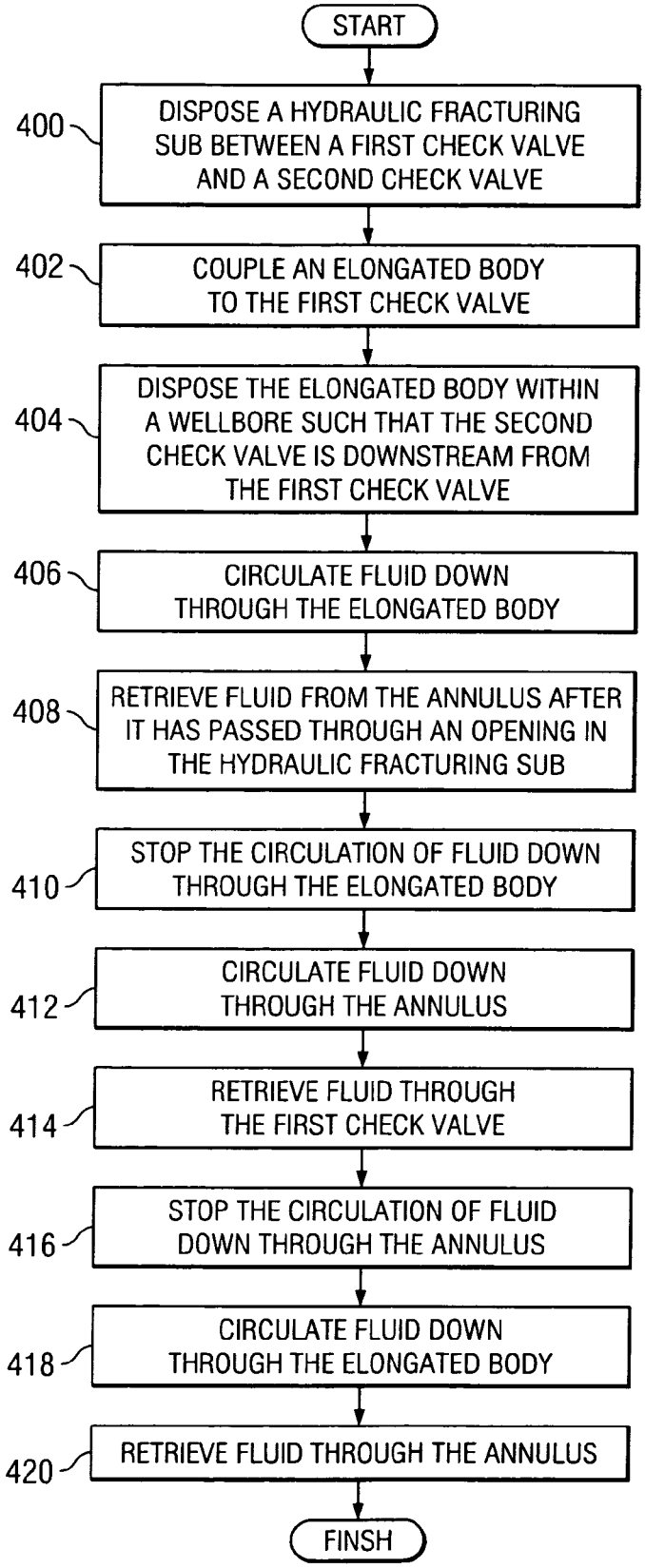
FIG. 4 is a flowchart illustrating a method for regulating fluid flow in a wellbore in accordance with an embodiment of the invention.

FIG. 4 is a flowchart illustrating an example method for regulating fluid flow in a wellbore in accordance with an embodiment of the invention. With additional reference to FIG. 3, the method begins at step 400 where an hydraulic fracturing sub, such as downhole tool 304, is disposed between first check valve 100*a* and second check valve 100*b*. An tubing 310 is coupled to first check valve 100*a*, as indicated by step 402. Tubing 310 is disposed within wellbore 302, as indicated by step 404, such that the second check valve 100*b* is downstream from the first check valve 100*a*.

Fluid is then circulated down through tubing 310 at step 406 and is retrieved from annulus 303 after it has passed through an opening or openings in downhole tool 304, as indicated by step 408. The circulation of fluid is then stopped at step 410. This stopping of the circulation of fluid causes the first check valve 100*a* to stay in the open position.

Fluid is then circulated down through annulus 303 at step 412 and retrieved through first check valve 100*a* after traveling through second check valve 100*b* and downhole tool 304, as indicated by step 414. This circulation of fluid is then stopped, as indicated by step 416, which causes second check valve 100*b* to stay in open position. At this point, both first check valve 100*a* and second check valve 100*b* are in an open position. Flow is then circulated down through tubing 310 at step 418. This fluid is retrieved through annulus 303, as indicated by step 420, after it travels through first check valve 100*a*, downhole tool 304, and second check valve 100*b*. This then ends the example method outlined in FIG. 4.

Although some embodiments of the present invention are described in detail, various changes and modifications may be suggested to one skilled in the art. The present invention intends to encompass such changes and modifications as falling within the scope of the appended claims.

What is claimed is:

1. A method of regulating fluid flow in a wellbore, comprising:

disposing a hydraulic fracturing sub between a first check valve and a second check valve;

coupling tubing to the first check valve;

disposing the tubing within a wellbore such that the second check valve is downstream from the first check valve;

circulating fluid down through the tubing to cause the first check valve to be in an open position;

retrieving fluid from an annulus of the wellbore after it has passed through an opening in the hydraulic fracturing sub;

stopping the circulation of fluid down through the tubing, thereby causing the first check valve to stay in the open position; and circulating fluid down through the annulus to open the second check valve; and retrieving fluid through the first check valve.

2. The method of claim 1 further comprising:

stopping the circulation of fluid down through the annulus, thereby causing the second check valve to stay in the open position;

circulating fluid down through the tubing; and retrieving fluid through the annulus.

3. The method of claim 1 further comprising stopping the circulation of fluid down through the tubing, thereby causing the first check valve to be in a closed position.

4. The method of claim 1 further comprising stopping the circulation of fluid down through the tubing, thereby causing the first check valve to stay in an open position.

5. A system of regulating fluid flow in a wellbore, comprising:

a first check valve;

a second check valve;

a hydraulic fracturing sub disposed between the first check valve and the second check valve; and tubing coupled to the first check valve and disposed within a wellbore such that the second check valve is downstream from the first check valve;

wherein:

the first check valve is configured such that a first circulation of fluid down through the tubing causes the first check valve to open and remain open when the first circulation of fluid is stopped; and the second check valve is configured such that a second circulation of fluid down through an annulus of the wellbore causes the first check valve to open and remain open when the second circulation of fluid is stopped.

6. The system of claim 5 wherein the first check valve is further configured such that it closes after a third circulation of fluid flows down through the tubing.

7. The system of claim 5 wherein the first check valve is further configured such that it remains open after a third circulation of fluid flows down through the tubing.

8. The system of claim 5 wherein the second check valve is further configured such that it closes after a third circulation of fluid flows down through the annulus.

9. The system of claim 5 wherein the second check valve is further configured such that it remains open after a third circulation of fluid flows down through the annulus.

10. The system of claim 5 wherein the first and second check valves each comprise:

a housing;

a guide member disposed within the housing, wherein the guide member has a bore extending therethrough;

a poppet having a head and a stem, wherein the head has a first surface engaged with a seating surface on the housing when the poppet is in a closed position; and a pin extending into a groove such that the pin follows a pattern of the groove when the poppet is translated within the housing.

11. A method of regulating fluid flow through a check valve during fracturing operations, comprising:

disposing a poppet in a housing;

allowing flow in only one direction through the housing when the poppet is in a first state;

allowing flow in both directions through the housing when the poppet is in a second state; and selectively switching between the first and second states by flowing fluid through the housing.

12. The method of claim 11 further comprising preventing flow in both directions through the housing when the poppet is in a third state.

* * * * *